United States Patent [19]

Hoffman

[11] Patent Number: 4,501,355

[45] Date of Patent: Feb. 26, 1985

[54] SOAP SAVING DEVICE HAVING NESTING DISHES

[76] Inventor: Edward C. Hoffman, 4 Kane Ct., Clarendon Hills, Ill. 60514

[21] Appl. No.: 613,581

[22] Filed: May 24, 1984

[51] Int. Cl.[3] ..... A47K 5/08; B65D 85/62; B29C 3/00; B29C 27/00

[52] U.S. Cl. ..... 206/77.1; 206/499; 206/503; 425/84; 425/318; 425/412; 24/16 PB; 220/8; 100/219

[58] Field of Search ..... 206/77.1, 499, 503, 206/558; 100/219; 425/84, 318, 412; 24/16 PB; 220/8

[56] References Cited

U.S. PATENT DOCUMENTS

| | | | |
|---|---|---|---|
| 1,607,024 | 11/1926 | Thomson | 206/499 |
| 1,837,784 | 12/1931 | Luckett | 220/8 |
| 2,526,987 | 10/1950 | Wilson | 100/219 |
| 3,148,430 | 9/1964 | Hanner | 425/318 |
| 3,407,079 | 10/1968 | Griffith et al. | 206/499 |
| 3,532,633 | 10/1970 | Withers | 206/77.1 |
| 3,804,239 | 4/1974 | O'Brien | 206/503 |
| 4,035,122 | 7/1977 | Cavanaugh | 425/318 |
| 4,135,272 | 1/1979 | Stephenson | 24/16 PB |
| 4,344,529 | 8/1982 | Ibarzabal | 206/77.1 |

*Primary Examiner*—William T. Dixson, Jr.
*Attorney, Agent, or Firm*—A. G. Douvas

[57] ABSTRACT

A soap saving device for pressure bonding two or more pieces of wet soap comprising a pair of soap dishes which may be nested together to pressure bond two or more pieces of soap located between the nested soap dishes, or alternatively each may be employed as independent and separate soap dishes. The different species are disclosed for developing a soap bonding or compressing force between the dishes. An elastic band is employed in a first species using identical nesting soap dishes. In the second species, a pair of tension bars, each formed with a series of surface locking ridges or grooves, is hinged to one soap dish so that they may pivot into locking alignment with a pair of slots each having a set of flexible locking tabs for engaging the locking ridges. In the third species, the sidewalls of a base soap dish are formed with several sets of exterior locking ridges which adjustably engage mating sets of locking ridges formed on the interior of the skirt of the top soap dish which nests over the base dish.

10 Claims, 22 Drawing Figures

SOAP SAVING DEVICE HAVING NESTING DISHES

The present invention relates to apparatus for conserving soap, and in particular to apparatus for pressure bonding two or more pieces of soap.

A bar of soap is rarely fully used. The thin slivers remaining after extensive use of a soap bar usually dry out and break into small unwieldy pieces which are generally thrown away.

As the price of soap increases with inflation, it becomes desirable for those on limited budgets to find an effective way of saving and using soap remnants.

Devices for pressure bonding two pieces of soap are disclosed in the prior art. U.S. Pat. Nos. 4,344,529, 2,975,485, 2,485,347, and 339,376 disclose typical prior art structures. While all of these devices are effective to bond pieces of soap, they have limited utility for other applications. This limited utility plus the relatively high cost to manufacture the individual components and to assemble them into a working combination has prevented the extensive use of soap saving devices in the home and elsewhere.

Accordingly, a principal object of this invention is to provide improved apparatus for pressure bonding pieces of soap. This apparatus is characterized by a simple design that enables the primary components to be employed on soap dishes having day-to-day utility.

A principal embodiment of the invention comprises a pair of soap dishes each of which may be employed as independent soap dishes, or alternatively, may be nested together to pressure bond two or more pieces of soap located between the nested soap dishes.

Three different species of the invention are disclosed for developing a soap bonding or compressing force between the dishes. In particular, an elastic band is employed in a first species, using identical nesting soap dishes. In the second species, a pair of tension bars, each formed with a series of surface locking ridges, is hinged to one soap dish so that they may pivot into locking alignment with a pair of slots each having a set of flexible locking tabs for engaging the locking ridges. In the third species, the sidewalls of a base soap dish are formed with several sets of exterior locking ridges which adjustably engage mating sets of locking ridges formed on the interior of the skirt of the top soap disn which nests over the base dish.

DESCRIPTION OF THE DRAWINGS

In order that all of the structural features for attaining the objects of this invention may be readily understood, detailed reference is herein made to the accompanying drawings wherein.

DESCRIPTION OF THE PREFERRED EMBODIMENTS

Figure 1:
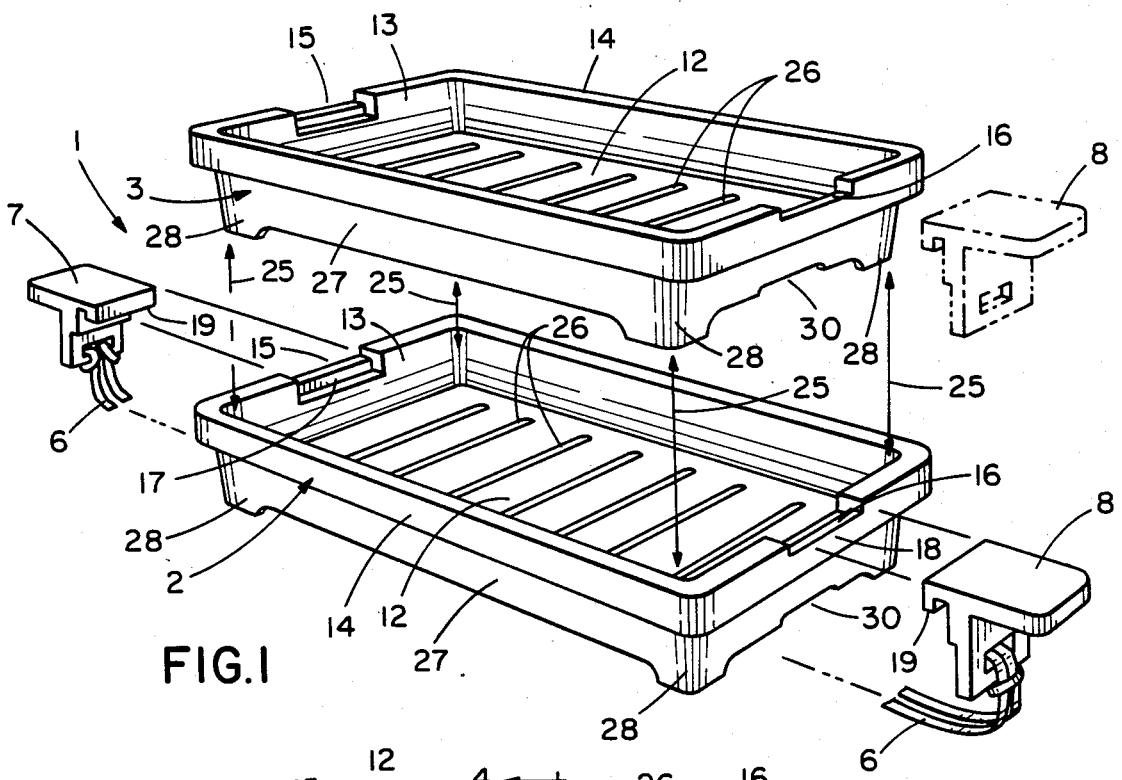
FIG. 1 is an exploded perspective view of a first preferred embodiment of the soap saving device of the invention employing a pair of soap dishes which are held in nesting engagement by a pair of clamps joined by an elastic band.
Figure 2:
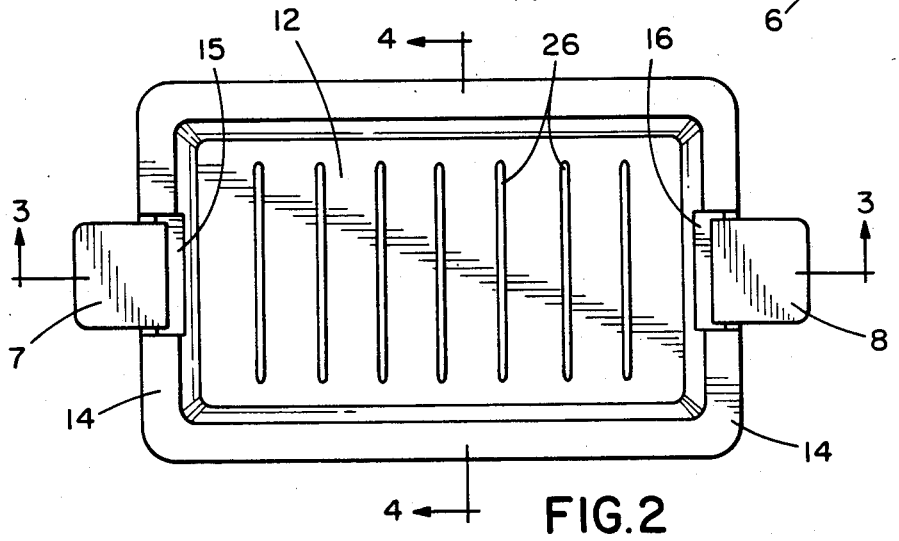
FIG. 2 is a top view of the structure of FIG. 1 when the clamps are engaged.
Figure 3:
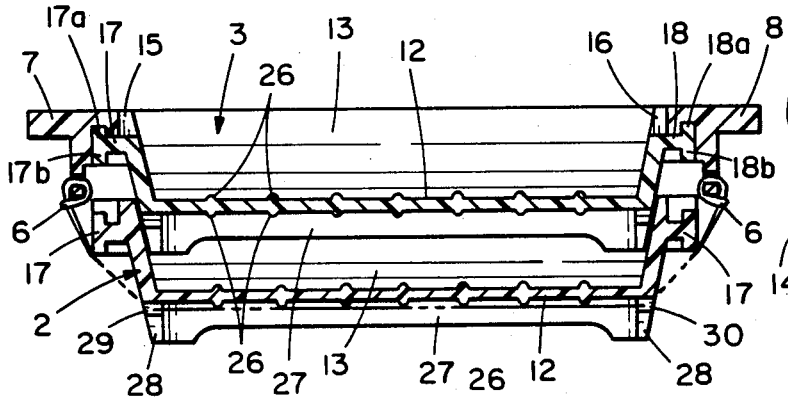
FIG. 3 is a section view taken along line 3—3 of FIG. 2.
Figure 4:
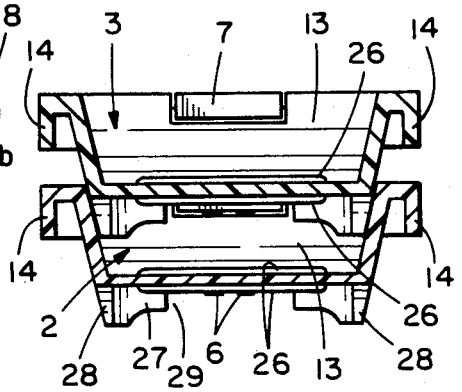
FIG. 4 is a section view taken along line 4—4 of FIG. 2.
Figure 5:
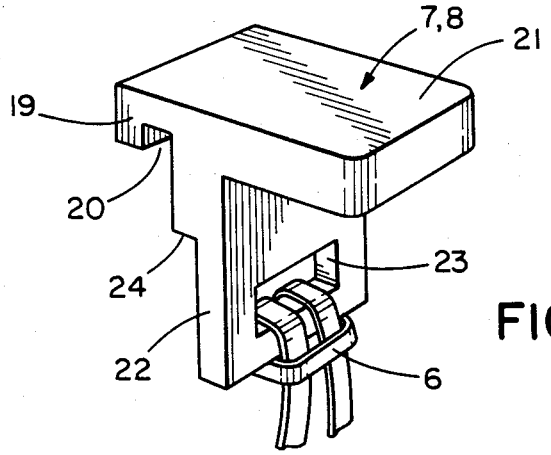
FIG. 5 is an enlarged perspective view of a clamp.

A first preferred embodiment of soap saving device 1 of this invention is shown in FIGS. 1–8 of the drawings. This embodiment features a pair of identical soap dishes 2 and 3 which may be nested, or stacked one upon the other as is shown in FIGS. 3 and 4. Alternatively, soap dishes 2 and 3 may be separated and used as independent soap dishes.

When it is desired to pressure bond two pieces of soap 4 and 5 together, the pieces are placed in base dish 2 and top dish 3 is seated on the upper piece of soap 5 (FIGS.

6, 7). The sandwiched pieces of soap are pressure bonded by a compressing force developed by elastic band 6 located below soap dish 2 and whose extended ends are tied to clamps 7 and 8.

Figure 8:
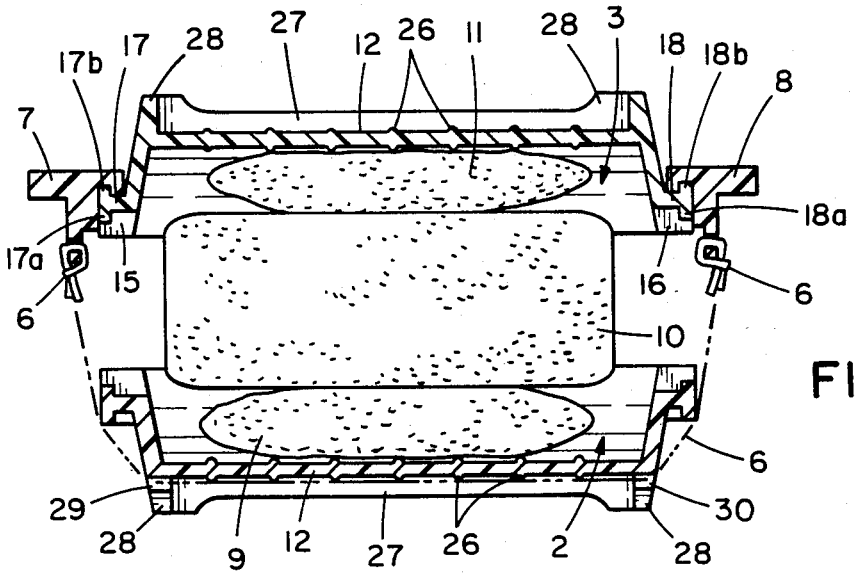
FIG. 8 is a section view related to the section view of FIG. 7, but showing the top soap dish in an inverted position to pressure bond three pieces of soap.
Figure 6:
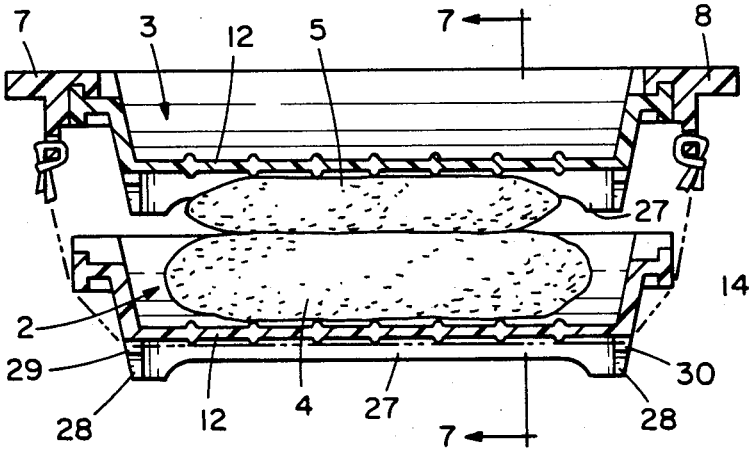
FIG. 6 is a section view of the soap saving device of FIGS. 1–5 showing two pieces of soap being pressure bonded into a single bar between the two soap dishes in the nested position.

FIG. 8 shows an alternate mode of use in which top dish 3 is inverted so that both dishes 2 and 3 can sandwich and pressure bond a relatively tall stack of soap pieces 9, 10 and 11. Clamps 7 and 8 are capable of engaging top soap dish 3 whether that dish is inverted or not.

The structural details of soap saving device 1 are as follows.

Figure 7:
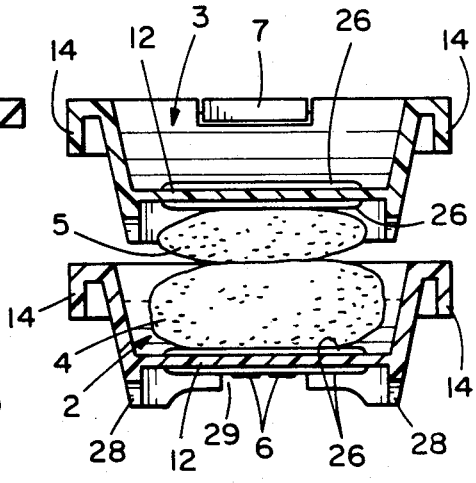
FIG. 7 is a section view taken along line 7—7 of FIG. 6.
Figure 9:
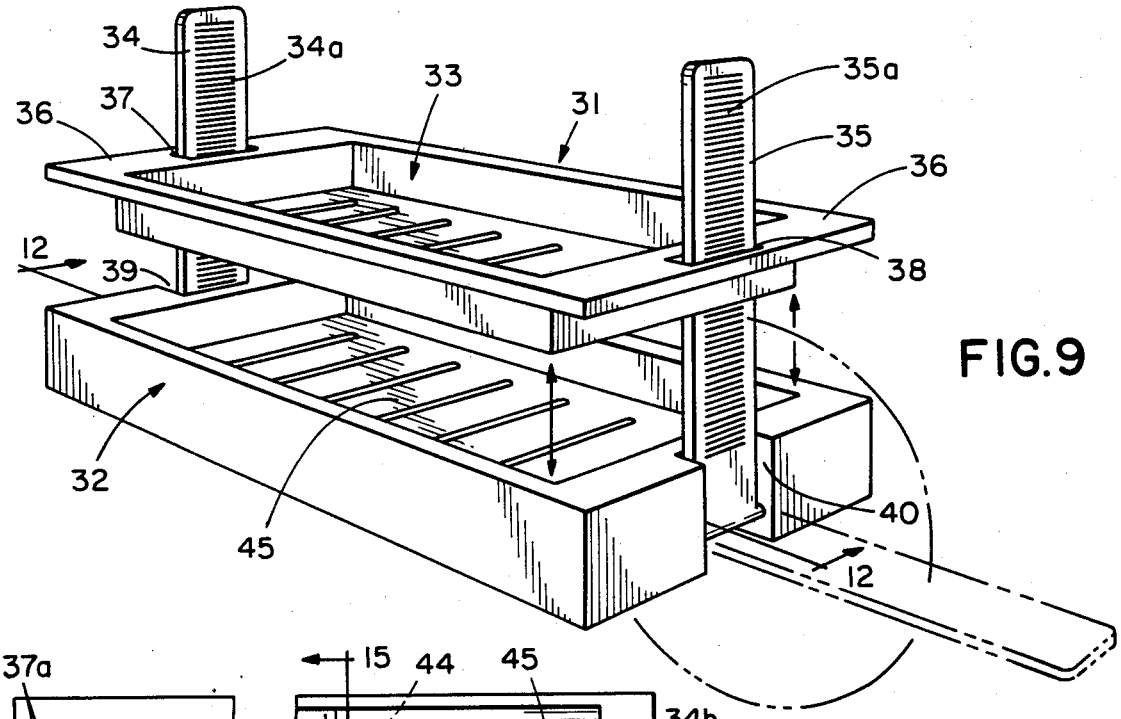
FIG. 9 is a perspective view of a second preferred embodiment of the soap saving device of this invention employing a pair of soap dishes which are held in nesting engagement by a pair of hinged tension strips.
Figure 10:
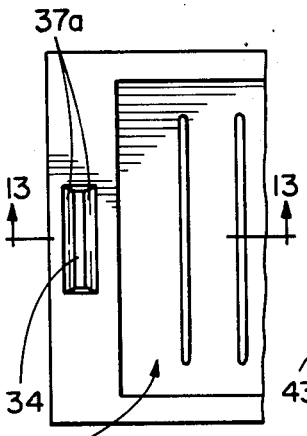
FIG. 10 is a fragmentary top view of the structure of FIG. 9 showing the locking engagement of one of the hinged tension strips.
Figure 11:
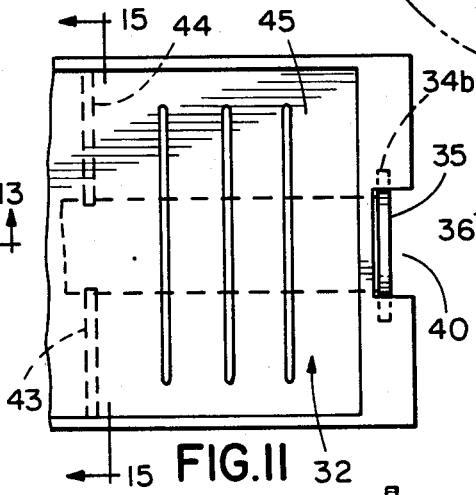
FIG. 11 is a fragmentary top view of one end of the bottom tray which shows in broken line the holes that receive the pivot shaft for a tension strip.

Both soap dishes 2 and 3 have an identical design which includes a configuration and size which will enable the soap dishes to nest together. The dishes may be fabricated from plastic, glass, wood, metal or other formable material. Each soap dish 2 and 3 comprises a bottom 12 outlined by a peripheral sidewall 13, which terminates in an L-shaped rim 14 (FIGS. 4, 7). Rim 14 extends around the complete periphery of sidewall 13 except at the set of opposing clamp-receiving notches 15 and 16. The bottom of each notch 15 and 16 is defined by a T-shaped rim 17 and 18, respectively. Each rim has a dual lip 17*a, b* or 18*a, b* which is engaged by either clamp 7 or 8 regardless of whether the top soap dish 3 is upright (FIG. 3) or inverted (FIG. 8).

Each clamp 7 and 8 (FIG. 5) is formed with an L-shaped hook portion 19 which defines a slot 20 which is sized to fit and seat firmly but easily on the associated lip 17*a, b* or 18*a, b*. In particular, lip 17*a* or 18*a* is engaged when top soap dish 3 is upright, or lip 17*b* or 18*b* is engaged when top soap dish 3 is inverted.

Each clamp 7 and 8 is formed with thumb tab 21 (FIG. 5) which is manually engaged to enable each clamp 7 and 8 to be lifted, disengaged or engaged with respect to an associated lip 17*a, b* or 18*a, b*. Clamp arm 22 is formed with a hole 23 to which elastic band 6 is tied. Alternatively, springs or other tension producing elements could be substituted for elastic band 6, and other means for fastening the elastic band, cord or spring employed to clamps 7 and 8 could be employed.

Clamp arm 22 (FIG. 5) is contoured to provide a step 24 on its operating surface positioned adjacent soap dish 3. The recession created by step 24 provides space for elastic band 6, and thus permits clamps 7 and 8 to rest in form contact with T-shaped rims 17 and 18.

The set of directional arrows 25 (FIG. 1) illustrates that top soap dish 3 lines up with bottom dish 2 and that dishes 2 and 3 can be separated one from the other by whatever distance may be required to pressure bond both relatively short (FIGS. 6 and 7) or relatively high (FIG. 8) stacks of soap.

Both sides of bottom 12 are formed with a set of parallel ridges 26 which provide a firm grip on both the upper and lower pieces of a soap stack sandwiched between the set of dishes 2 and 3.

Each soap dish 2 and 3 is also preferably formed with a skirt 27 which extends around the complete periphery of bottom 12. A set of support legs 28 is formed as extensions from the bottom corners of skirt 27; and a pair of notches 29 and 30 is formed in a pair of opposing sides of skirt 27 to receive elastic band 6. The unnotched portions of skirt 27 serve to conceal elastic band 6.

A second preferred embodiment of the soap saving device of this invention is shown in FIGS. 9–15. In this embodiment, soap saving device 31 employs a pair of dissimilar nesting soap dishes 32 and 33. Base soap dish 32 has two elongated tension bars 34 and 35 each pivoted within a notch 39 and 40, respectively, located at each end of the dish. Top soap dish 33 is formed with a peripheral flange 36 which has a pair of locking slots 37 and 38, each adapted to receive an associated tension bar 34 and 35, respectively.

Figure 12:
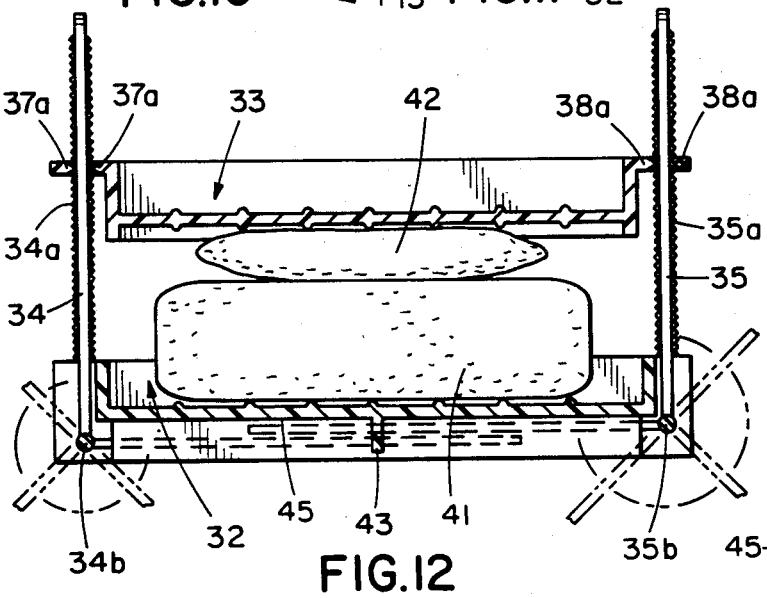
FIG. 12 is a section view taken along line 12—12 of FIG. 9 which shows the nesting engagement of soap dishes to pressure bond two pieces of soap.
Figure 14:
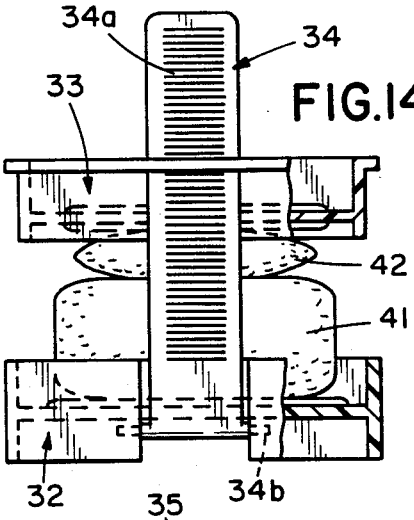
FIG. 14 is an end view of the second preferred embodiment with both soap dishes being in partial section, and which shows the vertical disposition of a tension strip on its pivot shaft.

The otherwise flat surfaces located on both sides of tension bars 34 and 35 are each formed with a series of closely spaced locking grooves, 34*a* and 35*a*, respectively. When tension bars 34 and 35 are inserted within locking slots 37 and 38, locking grooves 34*a* and 35*a* are engaged by flexible tabs 37*a* and 38*a* which project into locking slots 37 and 38. Accordingly, top soap dish 33 can be pressed down manually to pressure bond soap pieces 41 and 42 sandwiched between the dishes (FIGS. 12, 14). This pressure is maintained until the locking engagement of flexible tabs 37*a* and 38*a* with grooves 34*a* and 35*a* is manually released.

Tension bars 34 and 35 may be fabricated of plastic, metal or any rigid, formable material which is capable of being molded or cut to include the series of V-shaped locking grooves 34*a* and 35*a* extending for substantially the full length of each bar 34 and 35. One end of each bar 34 and 35 has a shaft 34*b* or 35*b* (FIGS. 11, 12 14) molded in, or attached to it, to form a hinge pivot for its associated bar. The ends of each shaft 34*b* and 35*b* are received by a set of holes formed in the portions of the sidewalls of base dish 32 which define notches 39 and 40, respectively. Alternatively, the required hinging action could be accomplished by integrally molding a plastic hinge on each plastic bar 34 and 35.

Figure 13:
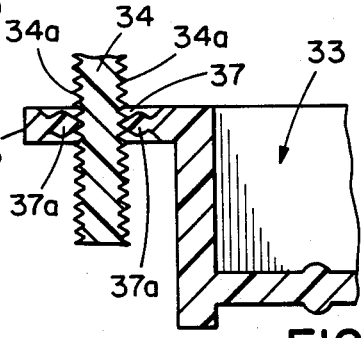
FIG. 13 is a section view taken along line 13—13 of FIG. 10 which shows the locking engagement of a tension strip by the flexible wedge tabs.

Locking slots 37 and 38 are molded or cut into each end of peripheral flange 36 of the top soap dish. Flexible tabs 37*a* and 38*a* are integrally molded to flange 36 so that they are flexible to permit guided up and down movement of top soap dish 33 (FIG. 13). Each tab is formed with a pointed tip so that a wedging action takes place with its associated tension bar 34, 35 which holds the top soap dish 33 in a desired position on bars 34 and 35 to develop a continuous pressure bonding force on any pieces of soap sandwiched between soap dishes 32 and 33.

Figure 15:
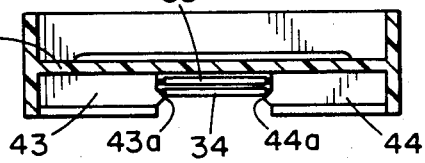
FIG. 15 is a section view taken along line 15—15 of FIG. 11 which shows the storage of the hinged tension bars beneath the lower soap dish.
Figure 17:
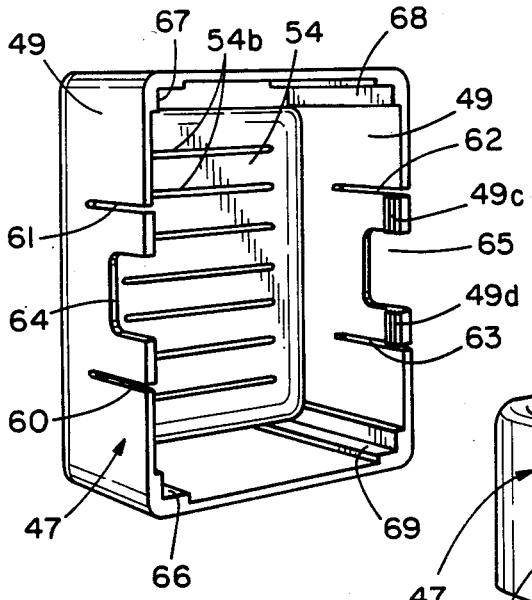
FIG. 17 is a perspective view of the upper soap dish of the third embodiment which shows the locking ridges of that dish.

A pair of spaced and longitudinally-aligned reinforcement wall sections 43 and 44 is molded to the underside of base soap dish 32 (FIG. 15). A tension bar retention tip 43*a* and 44*a* is formed on the central ends of walls 43 and 44, respectively, to project into the separation space between the wall. Retention tips 43*a* and 44*a* are spaced apart slightly less than the width of tension bars 34 and 35. The wall formed by sections 43 and 44 becomes a holding or storage device into which tension bars 34 and 35 may be pivoted and snapped beyond tips 43*a* and 44*a* to be held in a storage position nested under bottom 45 of base soap dish 32 (FIG. 12).

A third preferred embodiment of the soap saving device of this invention is shown in FIGS. 17–22. In this embodiment soap saving device 46 comprises two dissimilar nesting soap dishes 47 and 48. Top soap dish 47 is designed to seat over and slide down bottom dish 48.

Figure 16:
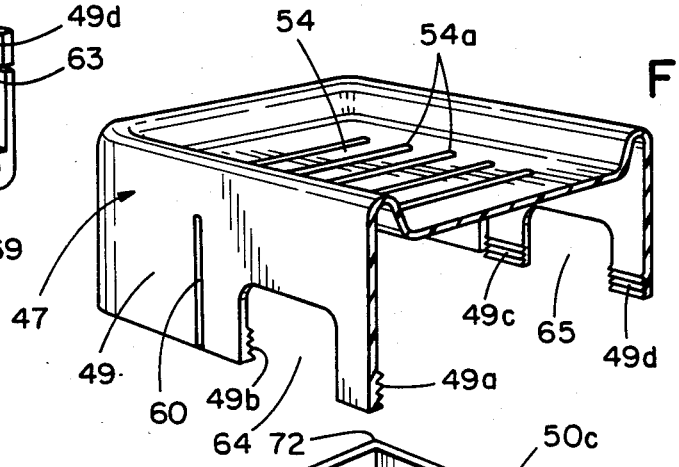
FIG. 16 is a perspective view of the upper soap dish of a third preferred embodiment of the soap saving device of this invention which discloses a structure in which the sidewalls of a pair of nesting soap dishes are formed with interlocking ridges which provide an adjustable pressure bonding force.
Figure 19:
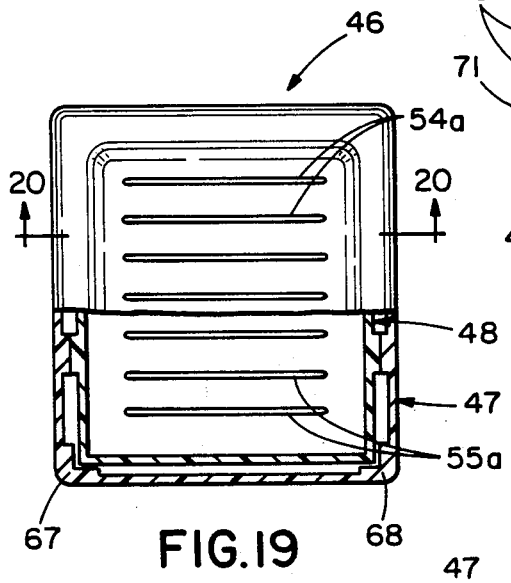
FIG. 19 is a partial section view which shows the nesting engagement of the two soap dishes of the third embodiment.
Figure 18:
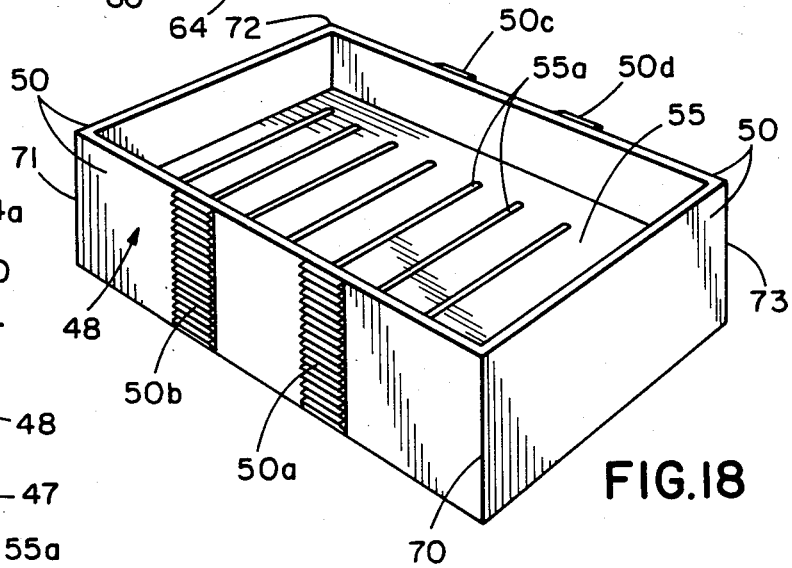
FIG. 18 is a perspective view of the lower soap dish of the third embodiment which shows the locking ridges of that dish.
Figure 20:
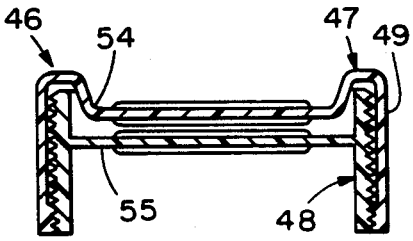
FIG. 20 is a section view taken along line 20—20 of FIG. 19 but modified to show both soap dishes fully nested.
Figure 21:
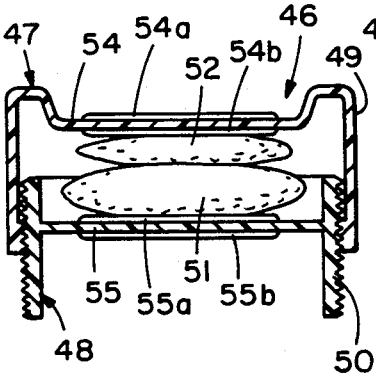
FIG. 21 is a view related to FIG. 20 which shows the two soap dishes partially separated to pressure bond two pieces of soap.

Top soap dish 47 is formed with a relatively shallow bed compared with the relatively deep bed of bottom soap dish 48. The inside surface of peripheral skirt 49 of top soap dish 47 is formed with four sets of grooved teeth 49*a*, 49*b*, 49*c*, and 49*d* (FIG. 16). The outside surface of peripheral sidewall 50 of bottom soap dish 48 is also formed with four sets of grooved teeth 50*a*, 50*b*, 50*c* and 50*d* (FIG. 18). Each of the four sets of grooved teeth 49*a*, 49*b*, 49*c* and 49*d* is disposed to engage adjustably an associated set of grooved teeth 50*a*, 50*b*, 50*c* and 50*d* (FIGS. 19–22).

Figure 22:
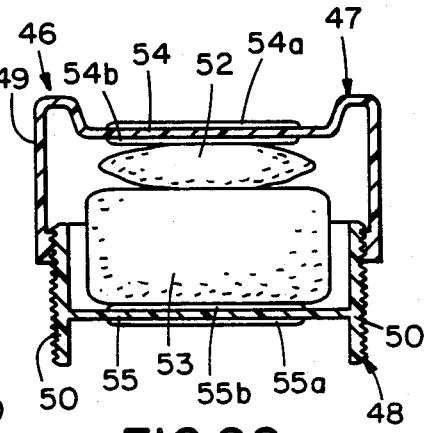
FIG. 22 is a view related to FIG. 21 which shows the two soap dishes separated to the maximum permissible extent to pressure bond a small piece of soap to a large soap bar.

When two pieces of soap 51 and 52 are sandwiched between nested soap dishes 47 and 48 (FIG. 21), the engaged soap dishes apply a pressure bonding force to form a unitary bar. If a thicker bar 53 is substituted for relatively thin soap piece 51 (FIG. 22), the bottoms 54 and 55 of nested soap dishes 47 and 48 must necessarily be separated to a greater extent. Adequate separation is made possible by inverting base soap dish 48 and then nesting the two soap dishes 47 and 48 as is shown in FIG. 22.

When soap dish 48 is inverted (FIG. 22), its off center bottom 55 is positioned approximately one-third the height of sidewall 50 measured from any dish 48 supporting surface (not shown). When soap dish 48 is not inverted (FIG. 20 and 21), its bottom 55 is disposed approximately two-thirds the height of sidewall 50 measured from any dish 48 supporting surface.

Both the upper and lower surfaces of soap dish bottoms 54 and 55 contain sets of parallel ridges 54*a, b* and 55*a, b,* respectively, in view of the fact that each soap dish may be used as a separate dish upon whose bed soap can rest and dry. Base soap dish 48 is used in the position shown in FIG. 21 and the inverted position of FIG. 22, also.

A set of four slits 60, 61, 62 and 63 (FIGS. 16, 17) is cut into skirt 49 of top soap dish 47 adjacent the set of grooved teeth 49*a*, 49*b*, 49*c* and 49*d*. These slits permit flexing of the skirt sections containing the grooved teeth, to allow the teeth to move up and down along the path of the mating teeth 50*a*, 50*b*, 50*c* and 50*d* of base soap dish 48.

Additionally, two thumb-sized notches or cut-outs 64 and 65 (FIGS. 16, 17) are formed in skirt 49 of top soap dish 47. These notches enable a manual finger-thumb gripping of base soap dish 48 when it is nested within the top soap dish 47.

A set of four right-angle guide slots 66, 67, 68 and 69 are molded into the four corners of top soap dish 47, extending from the bottom edge of the skirt to the inside top. The four glide slots receive the four corners 70, 71, 72 and 73 (FIG. 18) of the bottom dish 48.

The above described embodiments are merely illustrative of the principles of this invention. Structural modifications can be made without departing from the scope of the invention.

What is claimed is:

1. A soap saving device for pressure bonding two or more pieces of soap, comprising two separate soap dishes each having a bottom defining a soap supporting surface and each being sized and contoured so as to nest one within the other when stacked with the two bottoms being in face to face relationship, and with one dish serving as base dish and the other serving as a top dish, and means engageable between the two soap dishes exerting a force which tends to move the two soap dishes together and thus exerts a pressure bonding force on any two or more pieces of soap disposed between the two soap dish bottoms.

2. The combination of claim 1 in which the engageable means is a pair of clamps adapted for attachment to opposite sides of the upper soap dish and elastic means coupled to both clamps and adapted to extend around the bottom side of the base soap dish removed from the top soap dish to thus exert a pressure bonding force on any two or more pieces of soap disposed between the two soap dish bottoms.

3. The combination of claim 1 in which the engageable means is a pair of tension bars each formed with a set of closely spaced ridges or grooves and with each being hinged to an opposite side of the base soap dish, and a pair of flexible tabs each located on opposite sides of the top soap dish and each projecting into a different one of a pair of tension bar receiving slots located on opposite sides of the top soap dish in alignment with an associated one of the hinged tension bars so that when the tension bars are inserted into the associated slots the flexible tabs engage the ridges or grooves formed on the tension bars to thus exert a pressure bonding force on any two or more pieces of soap disposed between the two soap dish bottoms.

4. The combination of claim 1 in which the base soap dish is formed with sidewalls generally normal to the bottom of that dish, the top soap dish is formed with a skirt sized to be in a close space relationship with the sidewalls of the base soap dish when the two soap dishes are nested together, and the engageable means is one or more mating sets of closely spaced grooves or ridges formed on adjacent sidewall and skirt surfaces so that extent of nesting can be manually adjusted to thus exert a pressure bonding force on any two or more pieces of soap disposed between the soap dish bottoms.

5. The combination of claim 2 in which the top soap dish is formed with a pair of T-shaped rim sections with each rim section being located on an opposite side of the soap dish from the other section, and each clamp of the pair of clamps including a lock sized and contoured to engage an associated T-shaped rim so that the top soap dish may be engaged when inverted when compared to its nesting position and thus exert a pressure bonding force on a relatively taller stack of soap pieces.

6. The combination of claim 2 in which the elastic means is a rubber band.

7. The combination of claim 3 including means elevating the bottom of the base soap dish with respect to any supporting structure whereby the hinged tension bars can be pivoted to a storage position against the bottom of the base soap dish.

8. The combination of claim 7 including means latching the hinged tension bars in the storage position against the bottom of the base soap dish.

9. The combination of claim 4 in which the base soap dish is generally H-shaped in cross section and the top soap dish is generally U-shaped in cross section.

10. The combination of claim 9 in which the skirt of the top soap dish is notched on opposing sides of the skirt to expose adjacent portions of the top soap dish sidewalls so that the two soap dishes can be moved relative one another by manual engagement of the bottom soap at the notch exposed areas.

* * * * *